US006131704A

United States Patent [19]

Viita-Aho et al.

[11] Patent Number: 6,131,704

[45] Date of Patent: Oct. 17, 2000

[54] ELEVATOR RAIL BRAKE

[75] Inventors: Tarvo Viita-Aho, Hyvinkää ; Esko Aulanko, Kerava, both of Finland

[73] Assignee: Kone Oy, Helsinki, Finland

[21] Appl. No.: 09/015,905

[22] Filed: Jan. 30, 1998

[30] Foreign Application Priority Data

Jan. 30, 1997 [FI] Finland ..... 970390

[51] Int. Cl.[7] ..... B61H 7/12

[52] U.S. Cl. ..... 188/44; 188/165; 188/173

[58] Field of Search ..... 188/165, 171, 188/173, 43, 44; 187/288, 289, 351, 404, 287, 409

[56] References Cited

U.S. PATENT DOCUMENTS

| | | | |
|---|---|---|---|
| 3,554,327 | 1/1971 | Takamura | 187/409 |
| 3,762,512 | 10/1973 | McIntyre . | |
| 4,598,798 | 7/1986 | Koppensteiner | 187/409 |
| 5,014,828 | 5/1991 | Baldassarre | 187/288 |
| 5,033,587 | 7/1991 | Nakai et al. | 187/289 |
| 5,141,082 | 8/1992 | Ishii et al. | 187/289 |
| 5,159,995 | 11/1992 | Sissala et al. . | |
| 5,518,087 | 5/1996 | Hwang et al. . | |
| 5,547,059 | 8/1996 | Wantabe et al. | 187/289 |

FOREIGN PATENT DOCUMENTS

| | | |
|---|---|---|
| 0488809A2 | 6/1992 | European Pat. Off. . |
| 535344A1 | 4/1993 | European Pat. Off. . |
| 774439A1 | 5/1997 | European Pat. Off. . |
| 57264C | 11/1952 | Germany . |
| 255948A | 9/1994 | Japan . |
| 00157A | 1/1932 | United Kingdom . |
| 63328A | 12/1951 | United Kingdom . |

*Primary Examiner*—Robert J. Oberleitner
*Assistant Examiner*—Melanie Tala Vera
*Attorney, Agent, or Firm*—Birch, Stewart, Kolasch & Birch, LLP

[57] ABSTRACT

Rail brake (1) for an elevator, comprising a brake body attached to the elevator car, a clamp part comprising jaws (3,4) that engage a guide rail (2) via braking surfaces during braking. A spring (10) generates a load on the clamp part to press the braking surfaces against the guide rail, and a magnet whose force produces an effect reverse to that of the spring releases the braking surfaces from the guide rail. The clamp part is floatably suspended relative to the brake body. The motion of the clamp part relative to the brake body is controlled by the guide rail (2).

15 Claims, 2 Drawing Sheets

ELEVATOR RAIL BRAKE

FIELD OF THE INVENTION

The present invention relates to a rail brake.

A commonly used brake device is a clamp-type rail brake that grips a guide rail, in which the pressure of the braking surfaces against the guide rail is produced by spring force. Such a brake is often employed as a safety device to stop an elevator from upward or downward motion if the elevator is travelling at an excessive speed or for other reasons. In practice, placing a brake on the elevator car, especially adding a brake to an existing elevator, is difficult due to reasons relating to space utilization, because the brake must be rather large as it is subjected to large forces. A clamp-type brake device can also be used as the operating brake of an elevator. Clamp-type operating brakes have been employed e.g. in elevators provided with a linear motor. Such brakes have recently been described e.g. in specifications U.S. Pat. No. 5,518,087 and EP 0 488 809 A2. This type of brakes have braking surfaces or brake pads placed at the ends of the clamp jaws at a distance from the guide rail. The clamp is provided with a spring whose pressure on the jaws tends to press the braking surfaces or brake pads against the guide rail. To hold tendency in check, the brake is provided with a holding element, usually an electromagnet. This magnet or a separate electromagnet is used to release the brake.

In prior-art rail brakes, the jaws of the brake clamp are pivoted on a fixed fulcrum, with the consequence that the brake clamps have to be manufactured according to a specific design for each rail size separately. If this is not done, then using a rail brake on a guide rail having a different thickness than the rail for which the brake has been designed will lead to a misalignment between the guide rail and the brake surfaces. Due to this misalignment, the contact surface between the brake surfaces and the guide rail is reduced, resulting in a high surface pressure in the contact area. Due to the high local surface pressure, the brake surfaces are liable to uneven and fast wear. The wear of the guide rail is also faster than in the case of properly aligned brake and rail surfaces. Moreover, the misalignment involves an uneven surface pressure on the guide rail, causing unnecessary wear of the guide rail. The dependence of the brake on the guide rail size also means smaller production series and higher storage costs etc. of the brakes.

Prior-art brakes have a rather large clearance between the guide rail and the braking surface in order to ensure that the braking surface will not touch the guide rail when the brake is in the open position. The large clearance between the guide rail and the braking surface necessitates a long stroke of attraction of the magnetic device used to release the brake, which again leads to the need for a larger magnet. The long stroke required because of the large clearance also results in noise problems as the brake is closed by means of a spring. During a long stroke, the spring imparts more energy to the jaw movement than would be needed in the case of a short stroke. The placement of prior-art brakes is problematic because, if placed on the top of the elevator car or under it, they increase the total height of the car. Especially in the modernisation of old elevators, increasing the height of the elevator car might lead to a need to extend the elevator shaft to provide a sufficient space above the car. However, extending the elevator shaft is undesirable because of the high costs alone. Similarly, making substantial changes in the existing elevator car structure leads to considerable additional costs.

SUMMARY OF THE INVENTION

To overcome the problems described above and to achieve an improved rail brake, a new type of rail brake is disclosed. A specific object of the invention is to produce a rail brake construction that is more widely applicable to different uses. The rail brake of the invention is characterised a brake body attached to an elevator car;

a clamp part including jaws that engage a guide rail via braking surfaces during braking, the clamp part being suspended so as to float relative to the brake body in a direction substantially perpendicular to the braking surfaces of the jaws and in this direction, motion of the jaws relative to the brake body being controlled by a guide rail; a spring forming a load on the clamp part to press the braking surfaces against the guide rail; a controllable actuating device for applying force which produces a reverse effect to that of the spring on the clamp part; and a car guide of the elevator guide provided in the brake body, the car guide being a sliding guide.

The advantages afforded by the invention include the following:

The brake is reliable in operation and has a relatively light construction. The rail brake of the invention is suited for use in different types of elevator and different applications. The rail brake of the invention is simple in composition and straightforward in structure and it comprises only a small number of separate parts, being thus inexpensive to manufacture. The floating suspension principle employed in the brake makes it possible to achieve a short jaw movement, thus allowing a small-sized coil and coil core to be used in the electromagnet needed for releasing the brake and keeping it open, because the air gap is narrow.

A significant advantage of the brake is that the force of the same brake clamp, in which the distance between the clamp jaws is adjustable, can be varied by varying the rigidity of the load spring and the size of the magnet. Thus, a single brake clamp structure and size is applicable for use on guide rails having different thickness dimensions and for different loads.

By using a structure in which the air gap to be closed by the electromagnet is located inside the coil, the stray flux inside the iron circuit is reduced and the magnetic flux can be better directed to flow via the attraction air gap. This leads to a better efficiency regarding the attractive and holding force, which further contributes towards achieving a lighter structure. An oblique orientation of the air gap allows the use of an air gap that is narrower than the length of the closing movement, thus enabling the size of the magnet to be further reduced because the small air gap now allows the same attractive force to be obtained for a longer attraction movement. The obliquity of the air gap is, however, a matter of optimisation because, even though the attractive force increases as the air gap width decreases, the force component acting in the direction of attraction and producing the attraction movement is also decreased as the obliquity of the air gap is increased.

The coil core of the electromagnet can be used as a guide to direct the motion of the iron core during attraction, which means fewer parts and less weight. In practice, the brake of the invention does not increase the height of the elevator car because it can be integrated with a sliding guide of the elevator. As the upper and lower car guides of the elevator are placed as far apart as possible at the upper and lower corners of the car frame, a sliding guide integrated with the brake will not increase the height of the car. An integrated guide makes it possible to avoid a situation where a brake retrofitted as an accessory in the elevator would be an obstacle to the servicing of the sliding guide. Although in new elevators the mounting of the brake on the elevator structures could be so designed that the placement of the brake will not impair maintenance work on the guide, e.g. replacement of the slide block, integration of the brake and the sliding guide reduces the manufacturing costs.

The possibility of adjusting the distance between the joints of the clamp jaws makes the rail brake of the invention directly applicable for use with guide rails having different thickness dimensions. This distance adjustment allows misalignment between the guide rail and the braking surface to be avoided, which means that the brake will cause less wear of the guide rail and is itself less liable to wear. Because of the compact structure of the brake, integration of functions and the fairly small number of components, the brake is very durable.

In the rail brake applying the invention, the directions of the supporting forces applied to the clamp jaws due to the jointed jaw suspension remain substantially the same during the closing and releasing movements of the brake. Therefore, the direction of backlash in the jointed suspension will not be reversed between releasing and closing of the brake, thus contributing towards reducing the stroke length of the magnet used to release the brake and allowing more accurate releasing and closing movements. At the same time, impacts and wear of the joint due to reversal of backlash direction are avoided.

An important advantage is that the same basic structure of the rail brake is equally well applicable for use as an operating brake and as an emergency brake in an elevator. The possibility of using this brake as an emergency brake is a significant advantage, because conventionally a safety gear has been used as an emergency brake gripping a guide rail. Conventionally, the safety gears used only serve to brake downward motion of the elevator. The rail brake of the invention can easily be so controlled that it can also stop the elevator during upward travel. When the rail brake is used as an emergency brake, the braking surfaces are usually of a type that has a working effect on the guide rail, thereby ensuring a reliable grip of the rail and a large braking force in the relatively rare cases where the brake is applied. When the rail brake is used as an operating brake, the stopping of the elevator can be effected by means of the elevator drive machine, which may be e.g. an ordinary rope mechanism, a linear motor or a drive machine placed in the elevator car and acting on an elevator guide rail.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid of an embodiment example that in itself constitutes no restriction of the sphere of application of the invention, and by referring to the attached drawings, in which.

DETAILED DESCRIPTION OF THE PREFERRED EMBODIMENT

Figure 1:
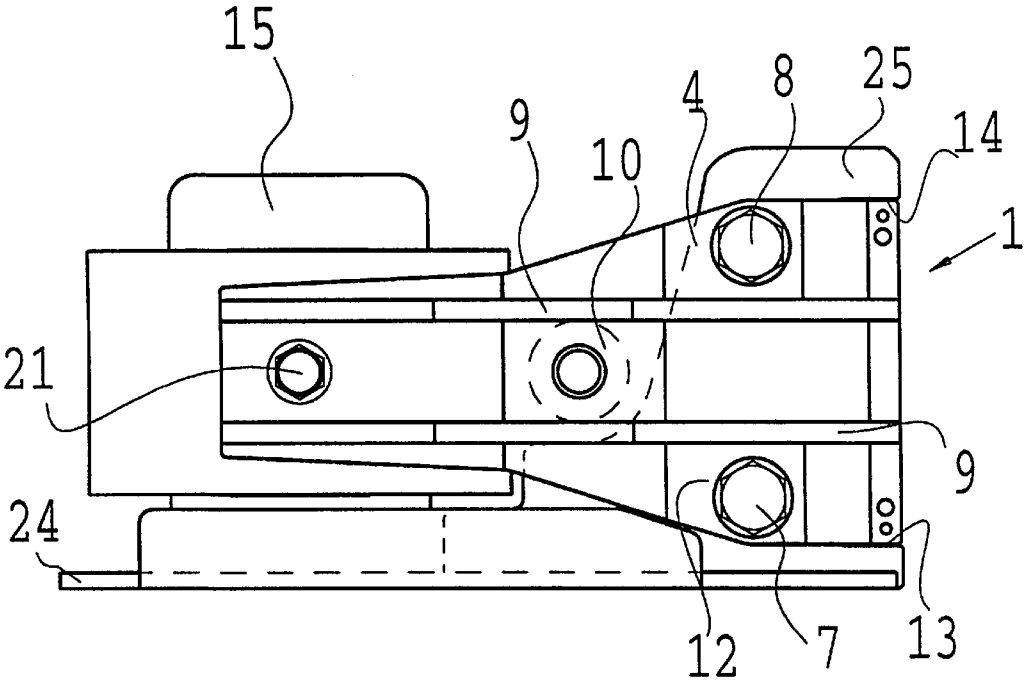
FIG. 1 presents the rail brake of the invention in side view.
Figure 2:
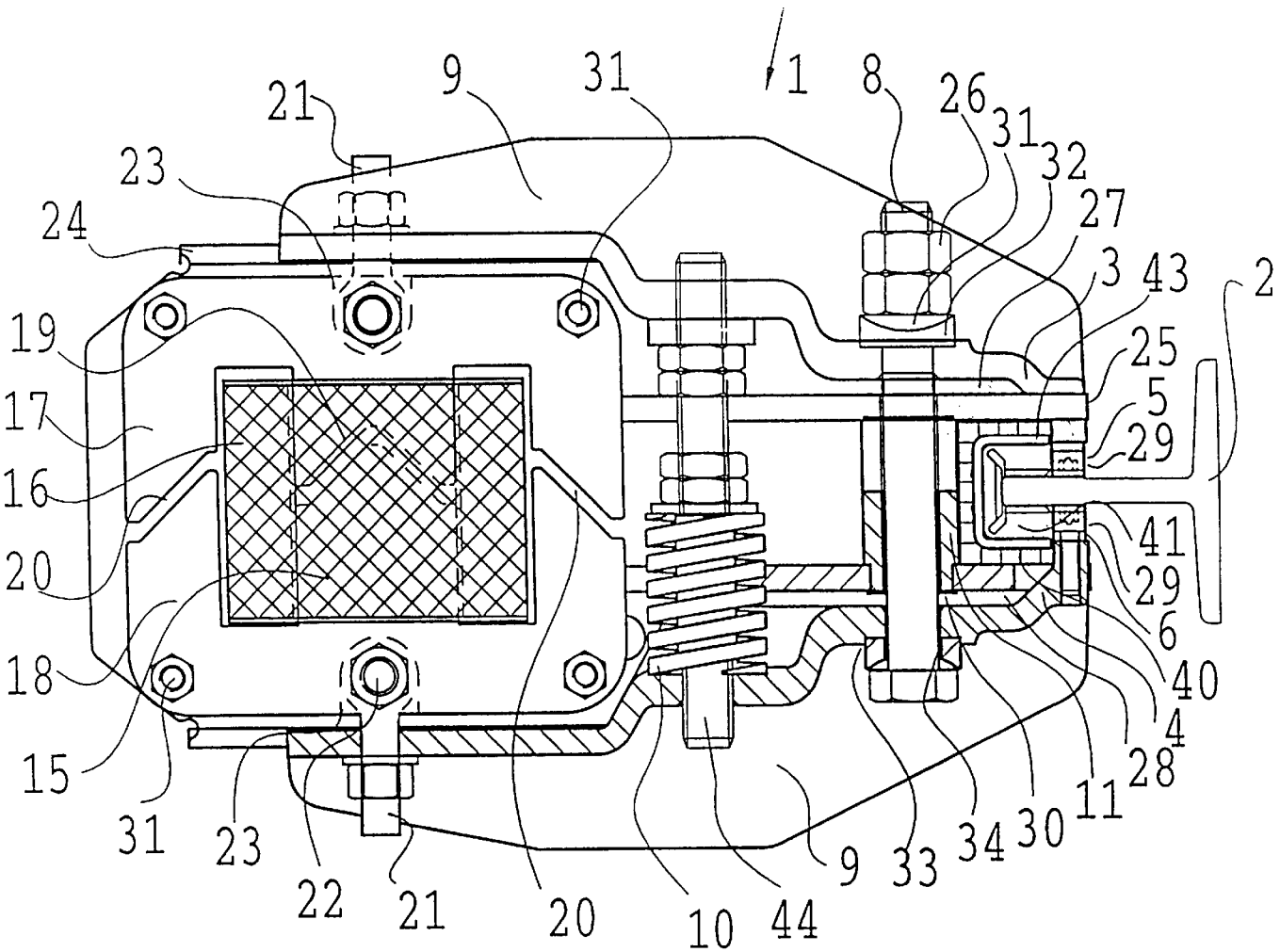
FIG. 2 presents the rail brake of the invention in top view.

FIG. 1 shows a rail brake 1 applying the invention, seen in lateral view, while FIG. 2 shows the same brake in top view. In FIG. 2, the guide rail 2 can be seen between the brake pads 5,6 attached to the jaws 3,4 of the brake clamp. The jaws 3,4 are linked to each other by means of bolts 7,8. The jaws 3,4 are reinforced with fins 9. The jaws are loaded by a spring 10 that forces the jaws farther from each other, causing the brake pads 5,6 to be pressed against the guide rail 2 as the jaws are pivoted by means of the bolts 7,8 between the brake pads 5,6 and the spring 10 so that the jaws cannot move farther apart in the region of the bolts. A central pin 44 guides the spring 10.

The rail brake is released and kept open by a power means 15, preferably a magnet, which produces a controllable movement. The control of the magnet or other actuating device can be effected by the elevator control system using a separate operating device or switch. Braking can also be initiated from elevator overspeed via triggering by an overspeed governor. Braking triggered by the overspeed governor is started when an overspeed activates a switch provided in the overspeed governor. The switch breaks the supply of electricity to the electromagnet used as power means of the rail brake, thereby removing the magnetic force keeping the brake open, so that the brake pads are pressed against the guide rail.

The magnet comprises a coil 16 and a magnetic core consisting of two parts 17,18. The parts 17,18 forming the magnetic core preferably consist of stacks of E-shaped plate elements, so it is possible to assemble magnetic cores of different sizes by stacking different numbers of E-shaped plate elements. The stacks of plate elements are put together using bolts or other suitable means. To avoid eddy current problems, it is advisable to isolate the individual plate elements of the magnetic core from each other if the magnet is to be controlled by a.c. power. If the coil of the magnet is controlled by d.c. power, then the magnetic core can be implemented as a solid iron body. A preferable method of controlling the magnet is to use a larger current to release the brake and a smaller current to keep it released. The middle claw of the E-shaped elements goes inside the coil while the other claws go outside it. The two parts 17,18 of the magnetic core are separated by an air gap, which may be oriented in a direction perpendicular to the direction of attraction, or preferably in an oblique direction relative to the direction of attraction. The actual attraction air gap 19 is inside the coil 16 while outside the coil there are air gaps 20 that the return flux of the magnetic circuit must cross. The force produced by the magnet is naturally generated across all air gaps 19,20. The magnet 15 is fixed to the jaws 3,4 by means of screw rings 21 and bolts 22. To reduce bolt length, a cutout 23 is provided in the magnetic core to receive the joint between the screw ring and the core. This structure allows a small movement of the magnetic core 17,18 relative to the clamp jaws 3,4. The coil 16 is preferably wound around a hollow coil core. The coil core is a tubular body, often rectangular in cross-section especially when the magnetic core is composed of plate elements, which in a completed magnet surrounds the middle claw of the E-shaped magnetic core elements. In the case of a solid-iron magnetic core, a coil core of a round cross-sectional form may be preferable. This coil core can be used as a guide for the movable magnetic core elements. As the coil core is usually made of plastic, it is preferable, especially in the case of an operating brake, to provide the coil core with separate sliding surfaces or make it otherwise more wear-resistant.

The rail brake is attached to the elevator car or car frame by its base 24, on which the brake body 25 of the rail brake is mounted. The brake body comprises sockets 11,12, which serve as guides for the bolts 7,8 as the brake floats. The sockets also make the brake body 25 more rigid as they connect different parts of it. The turning joint of the clamp consists of a structure in which the clamp jaws lean outward supported by ball washers 31 resting on conical rings 32, the ball washers being placed at a distance from each other and held in place by bolts 7,8 and nuts 26 screwed on them. Instead of the cheaper conical ring, it is also possible to use a washer with a concave spherical surface. The conical rings 32 are placed in machined recesses 33 in the jaws 3,4 of the rail brake clamp, the bottom of each recess 33 being provided with a hole 34 for the bolt 7,8 holding the structure together. A clearance is provided between the hole 34 and the bolt 7,8 to permit the turning motion relative to the jaw 3,4 that is needed for the action of the turning joint of the bolt. The distance is so selected that a total clearance, consisting of individual clearances 27 and 28, sufficient for the floating suspension is left between the brake body 25 and the jaws 3,4. This total clearance is the play of the rail rake, defining the scope of float of the rail brake in he horizontal direction.

The vertical force that braking generates in the rail brake 1 is received by the brake body 25. To receive this force, the jaws 3,4 are permitted both to turn slightly in the vertical plane and to move due to the floating suspension clearances between the jaws and the brake body, so the jaws can meet downward surfaces 14 or upward surfaces 13 in the brake body. The upward surfaces 13 and downward surfaces 14 are located near the jaw tips engaging the guide rail 2, the upward surfaces being located below the jaw and the downward surfaces above the jaw. The vertical jaw movement permitted by the clearances of the floating suspension is larger than the maximum vertical movement permitted by the clearances between the jaws 3,4 and the upward 13 or downward 14 surfaces. Thus, the jaws 3,4 always meet either the downward surfaces 14 or the upward surfaces 13 before the floating suspension clearances have been used up, which means that braking will not strain the floating suspension.

Attached to the brake body 25 between the jaws 3,4 is a sliding guide 43, which is isolated from the brake body 25 with a damping element 40 made e.g. of rubber. The slide blocks 41 of the sliding guide touch the guide rail 2 from three directions. Thus, the rail brake encloses a sliding guide built on the same base with it. Such a nested structure will not increase the height dimension, and the rail brake and the sliding guide together are accommodated in substantially the same vertical space that would be required for a rail brake or sliding guide alone. The slide blocks of the sliding guide can be replaced simply by inserting from the direction of the face of the sliding guide. In the vertical direction, the slide block 41 is secured in position by means of a locking element 42, being thus prevented from moving in one vertical direction by the base 24 and in the other vertical direction by the locking element 42.

The horizontal position of the clamp of the rail brake 1 is adjusted by means of slide blocks 29 guided by the guide rail. The slide blocks 29 have been placed on each clamp jaw 2,3 either in conjunction with the brake pad or apart from the brake pad/braking surface. The total clearance between the braking surfaces and the guide rail is larger than the clearance between the slide blocks and the guide rail. Controlling the clamp position, the slide blocks follow the guide rail 2 at least on one side with a relatively light pressure definitely smaller than the force of the clamp pressure during braking, thus keeping the brake clamp substantially centralised relative to the rail. The slide blocks 29 on both sides of the guide rail are preferably in contact with the rail all the time, thus continuously guiding the clamp. Continuous control makes it possible to achieve a very small clearance, even clearly below 1 mm, between the guide rail 2 and the braking surface. The slide blocks 29 have a resilient compressible structure, so they will not prevent the braking surfaces from reaching the guide rail or the clamp from squeezing the guide rail during braking. For easier float, the sockets 11,12 are preferably provided with sliding bearings 30 to reduce the force needed for position control and applied to the slide blocks 29 from the guide rail 2.

Figure 3:
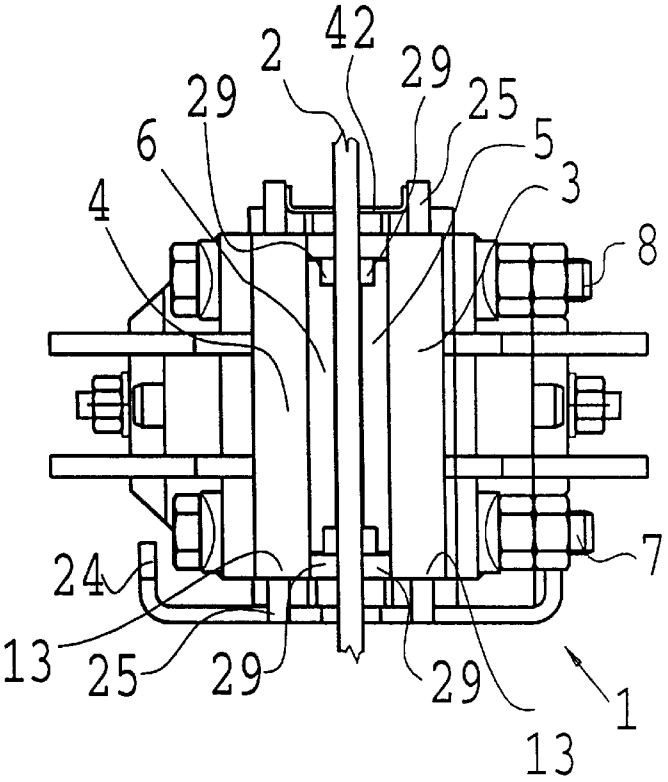
FIG. 3 presents the rail brake of the invention as seen from the direction of the guide rail.

FIG. 3 shows the rail brake as seen from the direction of the guide rail. The guide rail 2 is in the gap between the jaws 3,4. The slide blocks 29 are in contact with the guide rail 2. The brake pads 5,6 are at a distance from the guide rail.

It is obvious to the person skilled in the art that different embodiments of the invention are not restricted to the examples presented in the foregoing, but that they may instead be varied in the scope of the claims presented below. For instance, it is obvious that the brake may engage the guide rail via braking surfaces formed directly on the jaws instead of via braking surfaces of separate brake pads.

What is claimed is:

1. A rail brake for an elevator, comprising:

a brake body attached to an elevator car;

a clamp part including jaws that engage a guide rail via braking surfaces during braking, the clamp part being suspended so as to float relative to the brake body in a direction substantially perpendicular to the braking surfaces of the jaws and in this direction, motion of the jaws relative to the brake body being controlled by a guide rail;

a spring forming a load on the clamp part to press the braking surfaces against the guide rail;

a controllable actuating device for applying force which produces a reverse effect to that of the spring on the clamp part; and a car guide of the elevator provided in the brake body, the car guide being a sliding guide.

2. The rail brake as defined in claim 1, wherein the rail brake is substantially of a same height with the sliding guide normally used with the elevator car.

3. The rail brake as defined in claim 1, wherein a distance between the jaws of the rail brake is adjustable.

4. The rail brake as defined in claim 1, further comprising a jointed suspension for the rail brake jaws, directions of supporting forces applied to the clamp jaws due to the jointed jaw suspension being substantially independent of whether the rail brake is being closed or released.

5. The rail brake as defined in claim 1, further comprising a jointed suspension for the rail brake jaws for closing and releasing movements, the jointed suspension including a part by which the clamp part is floatably suspended relative to the brake body.

6. The rail brake as defined in claim 1, wherein the controllable actuating device includes an electromagnet with an air gap between magnetic core components thereof, the air gap being oriented in an oblique direction relative to a direction of attraction of the electromagnet.

7. The rail brake as defined in claim 1, wherein a motion of the jaws relative to the brake body is controlled by the guide rail via at least one guide element on the jaw, the element remaining in contact with the guide rail.

8. The rail brake as defined in claim 7, wherein the at least one guide element is resiliently compressibly towards the jaw under action of a closing force of the rail brake.

9. A rail brake for an elevator, comprising:

a brake body attached to an elevator car;

a clamp part including jaws that engage a guide rail via braking surfaces during braking, the clamp part being suspended so as to float relative to the brake body in a direction substantially perpendicular to the braking surfaces of the jaws and in this direction, motion of the jaws relative to the brake body being controlled by a guide rail;

a spring forming a load on the clamp part to press the braking surfaces against the guide rail;

a controllable actuating device for applying force which produces a reverse effect to that of the spring on the clamp part; and a motion of the jaws relative to the brake body being controlled by the guide rail via at least one guide element on the jaw, the element remaining in contact with the guide rail.

10. The rail brake as defined in claim 9, wherein the rail brake is substantially of a same height with the sliding guide normally used with the elevator car.

11. The rail brake as defined in claim 9, wherein a distance between the jaws of the rail brake is adjustable.

12. The rail brake as defined in claim 9, further comprising a jointed suspension for the rail brake jaws, directions of supporting forces applied to the clamp jaws due to the jointed jaw suspension being substantially independent of whether the rail brake is being closed or released.

13. The rail brake as defined in claim 9, further comprising a jointed suspension for the rail brake jaws for closing and releasing movements, the jointed suspension including a part by which the clamp part is floatably suspended relative to the brake body.

14. The rail brake as defined in claim 9, wherein the controllable actuating device includes an electromagnet with an air gap between magnetic core components thereof, the air gap being oriented in an oblique direction relative to a direction of attraction of the electromagnet.

15. The rail brake as defined in claim 9, wherein the at least one guide element is resiliently compressibly towards the jaw under action of a closing force of the rail brake.

* * * * *